United States Patent [19]

Gigliotti, Jr. et al.

[11] 4,202,400

[45] May 13, 1980

[54] DIRECTIONAL SOLIDIFICATION FURNACE

[75] Inventors: Michael F. X. Gigliotti, Jr., Scotia; Thomas F. Sawyer, Ballston Lake, both of N.Y.

[73] Assignee: General Electric Company, Schenectady, N.Y.

[21] Appl. No.: 944,892

[22] Filed: Sep. 22, 1978

[51] Int. Cl.[2] ..... B22D 27/02

[52] U.S. Cl. ..... 164/251; 164/338 M; 219/10.49 R; 219/10.43

[58] Field of Search ..... 164/60, 122, 125, 126, 164/127, 128, 251, 338 R, 338 M, 338 H; 219/10.43, 10.49 R; 13/26, 27; 174/35 CE

[56] References Cited

U.S. PATENT DOCUMENTS

| | | | |
|---|---|---|---|
| 3,461,215 | 8/1969 | Reboux | 219/10.49 |
| 3,702,368 | 11/1972 | Hukin | 219/10.49 |

*Primary Examiner*—Robert D. Baldwin
*Assistant Examiner*—K. Y. Lin
*Attorney, Agent, or Firm*—Leo I. MaLossi; James C. Davis, Jr.

[57] ABSTRACT

A directional solidification furnace is provided in which the susceptor is characterized by at least one substantially longitudinal slot to provide interference with eddy current motion and lower the furnace temperature in the slotted region and cause the highest temperature to be near the solid-liquid interface of a casting contained therein.

5 Claims, 1 Drawing Figure

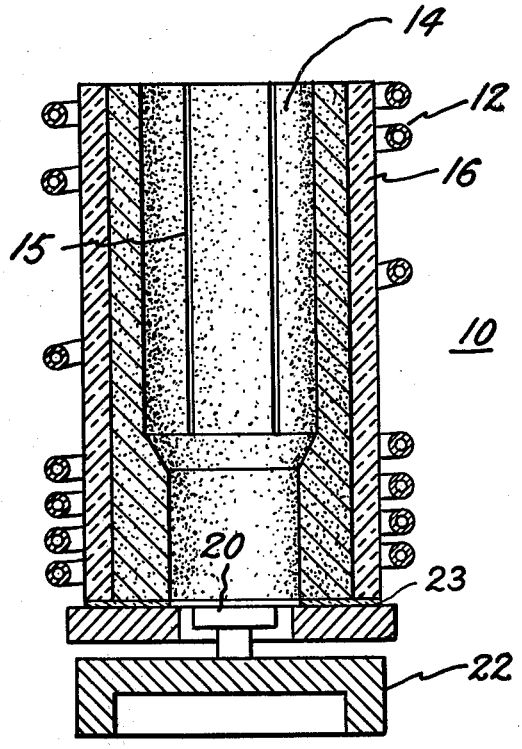
14
12
16
15
10
20
23
22

DIRECTIONAL SOLIDIFICATION FURNACE

BACKGROUND OF THE INVENTION

Superalloys are heat resistant materials having superior strength and oxidation resistance at high temperatures. Many of these alloys contain iron, nickel or cobalt alone or in combination as the principal element, together with chromium to impart surface stability and usually containing one or more minor constituents such as molybdenum, tungsten, columbium, titanium and aluminum for the purpose of effecting strengthening. The physical properties of the superalloys make them particularly useful in the manufacture of gas turbine components.

The strength of superalloys is determined in part by their grain size. At low temperatures fine grained equiaxed structures are preferred. At high temperatures large-grained size structures are usually found to be stronger than fine grained. This is believed related to the fact that failure generally originates at grain boundaries oriented perpendicular to the direction of the induced stress. By casting a superalloy to produce an elongated columnar structure with unidirectional crystals aligned substantially parallel to the long axis of the casting, grain boundaries normal to the primary stress axis can be almost completely eliminated. Further, by making a single crystal casting of a superalloy, such failure under stress is entirely eliminated.

Directional solidification to produce columnar casting and the apparatus used for this purpose are described in The Superalloys, edited by C. T. Sims et al., John Wiley & Sons, (1972), pages 479–508. Columnar grains are formed in a casting where the flow of heat is unidirectional from the liquid through the solid.

The temperature gradient at the solid-liquid interface of a casting in any directional solidification apparatus is a major factor which regulates the maximum rate unidirectional solidification can occur while maintaining good phase alignment throughout the length of the ingot. An increase in growth velocity requires an increase in temperature gradient in order to maintain the same ratio of temperature gradient to growth velocity.

Typically a ceramic investment casting mold is attached to a water-cooled copper chill plate and placed in an induction-heated graphite susceptor or resistance heated furnace. The mold is heated above the melting point of the alloy being cast and a superheated melt is poured into the mold. Heat enters the upper portion of the mold by radiation from the susceptor or other heat source and is removed through the solidified metal by the chill at the bottom. Thus, solidification occurs in an upward direction through the casting and the rate of solidification is a function of the amount of heat entering at the top of the casting and the amount of heat extracted from the casting through the solid. Alternatively, the charge can be melted in situ, within the mold, by the furnace. After equilibrium is established, the mold assembly is lowered out of the heat zone and nucleation of solid occurs in the bottom of the mold. Directional freezing continues upward as the mold unit is lowered. Faster rates at this inherent temperature gradient introduces structure breakdown to cellular and/or dendritic morphologies which deleteriously affects the properties. Bottomless crucibles which allow contact between the ingot and a copper chill have increased the allowable solidification rate but the heat path may still be interrupted by oxide formation at the contact site or poor contact between the ingot and the chill due to surface roughness, lack of alignment or separation due to shrinkage of the ingot during cooling.

The conditions at the chill face are critical for proper unidirectional heat flow. The chill should be water cooled and have a high thermal conductivity. The surface of the chill must be cleaned before each casting run so that resistance to heat flow by oxide layers is minimized. Difficulties in obtaining uniform heat transfer at the chill face require that the mold be securely clamped to the chill plate. A major problem with this method is that solidification rate and temperature gradient decrease with distance from the chill.

In accordance with the invention described in U.S. Pat. No. 3,939,895, a method is provided of producing a directionally solidified cast alloy article in a shell mold. The method includes providing a mold having a cavity divided into an upper portion and a lower portion, the mold being disposed in a heating zone, placing one end of a longitudinal heat extractor element of said alloy into the lower portion of the cavity, said other end of said heat extractor extending therefrom and being exposed to a continuous flow of fluid coolant, heating said mold and said one end of said heat extractor placed therein at a temperature above the melting range of said alloy to melt a portion of said one end of the heat extractor, filling the mold with said alloy in a molten state and controllably lowering said mold out of the heating zone to allow the mold and contents thereof to cool and to establish directional solidification of the alloy in said cavity.

SUMMARY OF THE INVENTION

It has now been discovered that the method can be improved upon by means of a furnace comprising in combination a susceptor disposed within a vertical tube heated along its axis by induction coils and separated from a cool zone by insulating material, said susceptor characterized by at least one substantially longitudinal slot disposed along its length to a point where the highest furnace temperature is desired. It has been found that the slotted susceptor provides interference with eddy current motion so as to lower the furnace temperature in the slotted region and cause the highest temperature to be near the solid liquid interface. Accordingly by means of one or more slots in the susceptor one is able to maintain the temperature in the upper part of the furnace just sufficient to keep the metal molten and by this low temperature prevent reaction between the mold and the molten metal and also obtain a higher temperature gradient near the cool or chill plate so as to obtain a better structure in the resulting ingot. Thus, the slots enable one to maintain the upper furnace temperature at less than normally required in order to obtain the required temperature gradient and keep the metal molten and thus there is an energy savings with the use of the invention.

BRIEF DESCRIPTION OF THE DRAWING

The drawing is a schematic illustration of a furnace comprising the slotted susceptor for use in the invention.

DETAILED DESCRIPTION OF THE INVENTION

Referring now to the drawing, the furnace 10 conventionally used for a directional solidification is heated from outside by induction heating coils 12 which are preferably spaced in a non-uniform manner with a high density of turns near the bottom, in order to raise the electromagnetic flux density, and thus the temperature, at the base of the furnace. Within the furnace 10 is a susceptor 14 comprised of graphite, or a similar refractory electrical conducting material having one or more slots 15 extending through the wall thereof, this generally cylindrically-shaped member having electrical insulation 16 of a ceramic material disposed over its outer surface. Disposed within the susceptor is a shell mold (not shown) which is formed of a ceramic or similar material. The top portion of the mold is provided with an opening into which the molten alloy may be poured while the bottom portion of the mold is adapted to receive retractor 20 cooled by chill bar 22. The mold and retractor may be temporarily attached by any suitable temperature-resistant adhesive material and preferably the retractor contains a recess in its upper position for receiving molten alloy metal which is lined with a relatively frangible and heat resistant thermally conductive ceramic material in said recess which can be broken when the ingot is formed and the ingot removed to provide easy separation of the ingot from the retractor and mold as disclosed and claimed in copending application Ser. No. 935,588, filed Aug. 21, 1978. Chill plate 22 is water cooled on its bottom through a channel (not shown). The furnace including or excluding the induction coils may be placed in a chamber to control the atmosphere and thus prevent oxidation of the melt.

In the operation of the furnace, the mold assembly is preheated to a sufficiently high temperature to insure that the alloy in the upper portion of the retractor remains molten, water cooling having been established. The power setting and position of the mold assembly in the susceptor will govern the length of the melt-back into the heat retractor. When the predetermined settings have allowed the system to equilibrate, the desired alloy is melted in a crucible positioned above the mold using a separate power source.

The entire mold assembly is then lowered at a preselected rate. The solid-liquid interface will advance upward as heat is conducted through the retractor and carried away by water flowing at its base.

The susceptor having a length of ~ 12", outside diameter of ~ 4" and four axial slots of ~ 1/16" width and up to within 2 inches from the bottom where the highest temperature is desired responds to cause high heat conduction in the base region only. The slots may be equidistant from each other. In the upper region of the susceptor the slots produce little heat in response to an r.f. induction field as the slots interfere with eddy current motion. In the unslotted base region there is no interference with eddy current flow and high production results. Thus, for a given gradient the super heat is lowered and the position of the maximum temperature is moved closer to the solid-liquid interface to provide an alloy with excellent fiber morphology. Susceptor 14 can be made from a plurality of separate pieces which are fitted to form the desired shape, and these pieces may be made of different refractory materials.

Employing an alloy which is limited to a maximum melt temperature of about 1750° C. in order to prevent serious metal-mold reactions it was found that the thermal gradient at the solid-liquid interface in the casting in the unslotted region was about 120°–140° C./cm using a slotted susceptor as opposed to 80°–100° C./cm using an unslotted susceptor.

To minimize the loss of heat in the base of the susceptor by conduction, a layer of insulation 23 such as a fibrous alumino-silicate mat is placed between the chill plate and susceptor.

Using the apparatus of the present invention, unidirectionally solidified nickel-base carbide reinforced cast superalloy bodies having high strength and high stress rupture properties at elevated temperatures are prepared as disclosed by Walter et al., U.S. Pat. No. 3,793,012. The reinforced fibers present in the matrix are aligned single crystal fibers of metal monocarbides. The range of compositions of the unidirectionally solidified castings in weight percent is about 6.5–10% chromium, 14–23% tantalum, 0.5–1.5% carbon up to 5% aluminum, up to 1% titanium, up to 8.5% cobalt, up to 5.0% molybdenum, and the balance essentially nickel. A preferred composition, designated as TaC-1900 has high strength and high stress-rupture properties. The nickel-base superalloy can also be modified as disclosed by Walter, U.S. patent application Ser. No. 482,589, filed June 24, 1974 and having the same assignee as the instant application, to include by weight at least 2% rhenium, and at least 6% chromium and aligned reinforced fibrous phase of tantalum monocarbide embedded in the matrix.

Other alloys which can be employed in the process are cobalt-base tantalum carbide eutectic alloys as disclosed by Walter et al., U.S. Pat. No. 3,793,013 and having a composition in weight percent of up to 26% chromium, 13.5–19.0% tantalum, up to 10.0% nickel, up to 6.5% tungsten, up to 1% iron, 1.2–1.5% carbon and the balance essentially cobalt.

Those skilled in the art will understand that the term "substantially longitudinal" is used herein and in the appended claims to characterize the slot or slots in the susceptor and is intended to include slightly angled slots so long as the slot can reach the desired position at the top of the chill plate. The number of slots will depend upon their width, the alloys employed and the variables in the furnace design but can be easily determined without undue experimentation by one of ordinary skill in the art. Morever, while the invention has been described with reference to specific details of particular embodiments it is not intended to limit the scope of the invention except insofar as the specific details are recited in the appended claims.

We claim:

1. In a directional solidification furnace in which molten metal is passed through a temperature gradient to initiate solidification, which furnace comprises in combination a susceptor in the general shape of a vertically-disposed hollow cylinder, said susceptor being made of a refractory electrically conducting material, means disposed around and electrically insulated from said susceptor fo applying electromagnetic flux density thereto non-uniformly along the length thereof with the region of highest flux density being near the lower end of said susceptor, and cooling means disposed below the bottom end of said susceptor, the improvement wherein the wall of said susceptor has at least one elongated slot passing completely through the thickness of said wall, initiating at the top of said wall, and extending longitudinally therealong to terminate intermediate the top and bottom ends of said susceptor at a distance above said bottom end, which leaves said lower end of said susceptor wall intact in said region of highest flux density.

2. The furnace of claim 1 in which the susceptor is provided with a plurality of substantially longitudinal slots.

3. The furnace of claim 2 wherein the slots are equidistant from each other.

4. The furnace of claim 1 in which the susceptor is formed from several separate pieces which are fitted to form the desired shape.

5. The furnace of claim 4 in which the separate pieces are formed of different refractory materials.

* * * * *